US006554030B2

(12) United States Patent
Cheung et al.

(10) Patent No.: US 6,554,030 B2
(45) Date of Patent: Apr. 29, 2003

(54) PROGRESSIVE PUNCH

(75) Inventors: Nelson Cheung, Hoffman Estates, IL (US); Janusz Figiel, Mundelein, IL (US); Peter Drabarek, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 59 days.

(21) Appl. No.: 09/812,156

(22) Filed: Mar. 19, 2001

(65) Prior Publication Data

US 2002/0129501 A1 Sep. 19, 2002

(51) Int. Cl.[7] ..... B21F 15/04
(52) U.S. Cl. ..... 140/93.2; 140/152
(58) Field of Search ..... 140/93.2, 152

(56) References Cited

U.S. PATENT DOCUMENTS 789,193 A * 5/1905 Wickham ..... 140/152
2,229,786 A * 1/1941 Abbott ..... 140/152
5,097,874 A * 3/1992 Bobren ..... 140/93.2

* cited by examiner

*Primary Examiner*—Lowell A. Larson
(74) *Attorney, Agent, or Firm*—Donald J. Breh; Mark W. Croll; Lisa M. Soltis

(57) ABSTRACT

A progressive punch is used in a strapping machine for positioning and sealing an associated strap material around a load. The punch is positioned in a jaw assembly that includes a movable punch support and a fixed punch support configured to receive the associated strap therebetween. The movable and fixed supports each include at least one punch having at least two punching heads. The punching heads each have a height that is defined by a distance between an outermost peripheral point of the punching head and a plane perpendicular to the direction of movement. The heights of the punching heads are different from one another so that the punching heads progressively engage the strap, with the punching heads initially engaging the strap material at a different times from one another.

20 Claims, 4 Drawing Sheets

PROGRESSIVE PUNCH

BACKGROUND OF THE INVENTION

The present invention pertains to a progressive punch. In particular, the present invention pertains to a progressive punch for use in a strapping machine.

Strapping machines or strappers are well known in the art. These machines are used for strapping articles, e.g., a load, together with strapping material. Strapping material is offered in a variety of sizes and materials and is generally stored on a roll. Conventional strapping materials include steel and plastic.

Typically, a free end of strapping material is passed around the load until there is an overlap between the free end and the strapping material still connected to the roll. The overlapping portion of strapping material is placed between jaws of a strapping machine and the free end of the strapping material is fixed in place by a gripper portion of the machine. After the strapping material is fixed, the material is tightened or tensioned around the load to a desired tension. This is accomplished by operating a feed wheel to pull back or tension the strapping material.

A typical strapper includes sealing heads for sealing the free end of the strapping material onto itself, around the load. Typically, in manual (i.e., hand-operated) strappers, a handle is rotated which applies a force to cause a punch or sealing head to press down against the strap to seal the strap to itself. After the strapping material is sealed, the strapping material still connected to the roll is cut by a cutter, which is a portion of the strapper. This completes one strapping operation. This type of seal, which is effected by sealing the strap to itself, differs form those strappers that position a separate piece of material around the tensioned strap.

Considerable force is required to form the seal in the strapping material and to cut the material. As such, an operator may fatigue from repeatedly applying force while forming seals.

One known type of strapper uses a cammed arrangement by which the sealing heads are sequentially moved into engagement with the strap. Although this reduces the amount of force necessary to effect a seal, the mechanical movement (and thus the components required), is complex and results in increased maintenance to the strapper. In that many such strappers are used "in the field" increased maintenance typically results in a tool that has limited usefulness.

Accordingly, there is a need for a sealing head or punch that allows a sufficiently strong seal to be formed without requiring a sizeable actuating force. Desirably, such a sealing head includes one or more punch heads that are fixed relative to one another to provide this reduced-force arrangement. Most desirably, such a reduced-force arrangement is provided with a minimum of moving parts.

SUMMARY OF THE INVENTION

A progressive punch is used in a strapping machine that is used for positioning an associated strap material around an associated load and for readily forming a seal of the strap overlapped onto itself. An exemplary strapping machine includes a strapping machine body having a jaw assembly that includes first and second punch supports. The punch supports are configured to receive the strap therebetween. The first punch support includes two punches for engaging the strap; the second punch support includes one punch. Each of the punches includes at least two punching heads.

The punches and punching heads are configured to cooperate with one another so that the punching heads progressively engage the strap, so that the first punching head initially engages the strap at a different time than the second punching head initially engages the strap.

The punching heads can include a base and a cutting edge so that they are attached to their respective supports at their respective bases.

The second punch support is fixed and the first support is movable toward and away from the second support so that the two punches on the first support engage the associated strap when an actuating force-is applied to the strapping machine such as by rotating an actuating handle.

The punches of the movable support engage a first surface of the associated strap at first and second positions, and the punch of the fixed support engages a second surface of the associated strap at a third position when the punches engage the associated strap. The third position is opposite to the first and second positions.

Other features and advantages of the present invention will be apparent from the following detailed description, the accompanying drawings, and the appended claims.

BRIEF DESCRIPTION OF THE FIGURES

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
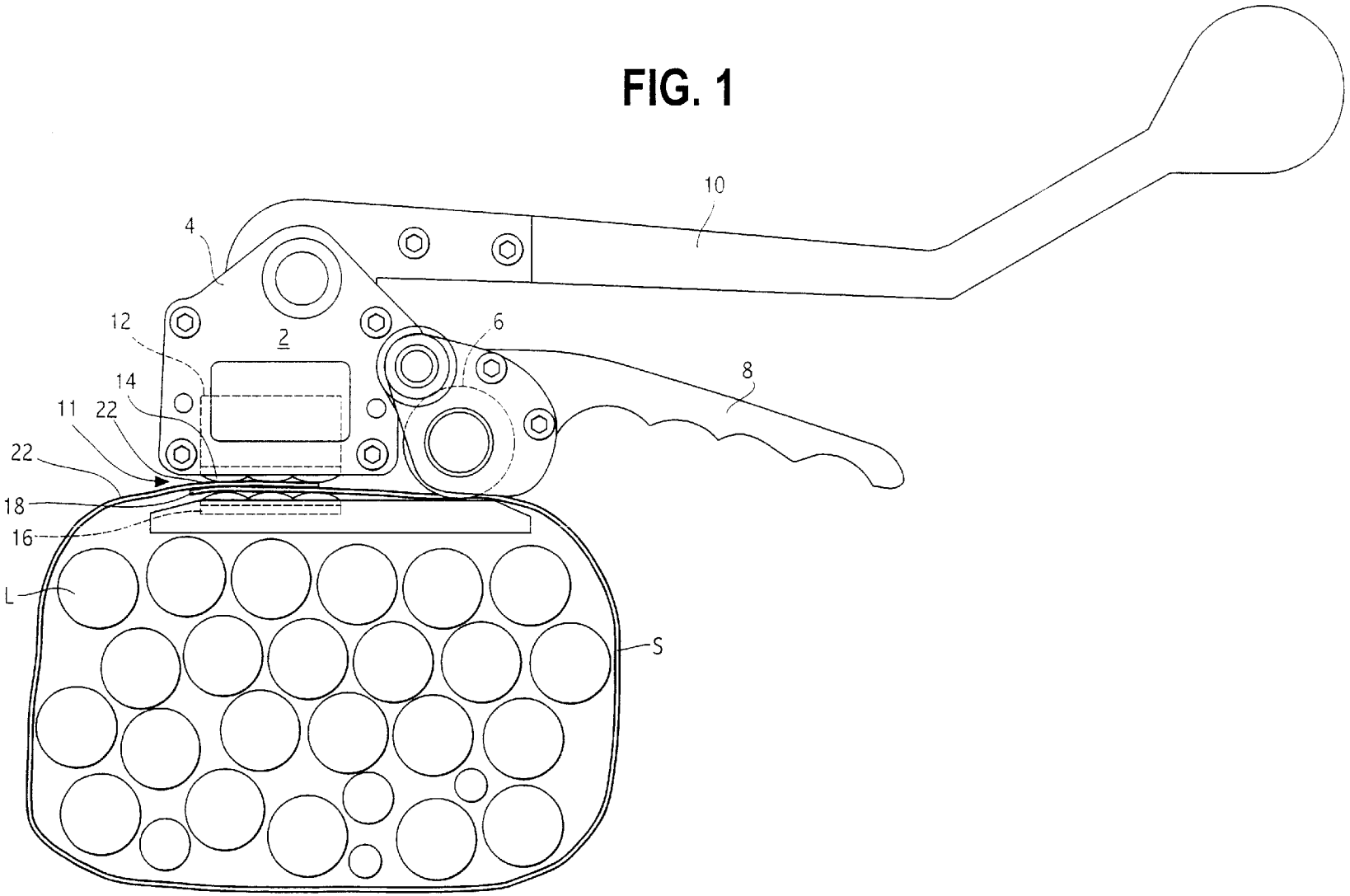
FIG. 1 illustrates an exemplary strapping machine having a progressive punch embodying the principles of the present invention.

While the present invention is susceptible of embodiment in various forms, there is shown in the drawings and will hereinafter be described a specific embodiment with the understanding that the present disclosure is to be considered an exemplification of the invention and is not intended to limit the invention to the specific embodiment illustrated. It should be further understood that the title of this section of this specifically, normally, "Detailed Description of the Invention," relates to a requirement of the United States Patent and Trademark Office, and does not imply, nor should be referred to limit the subject matter disclosed and claimed herein.

The invention may be used in a variety of strapping machines or tools (also referred to as strappers) such as the exemplary strapper 2 illustrated in FIG. 1. The illustrated strapper 2 includes a strapping machine body 4, a gripper (not shown), feed wheel 6 and accompanying feed lever (not shown). The strapper 2 further includes a cutter (not shown) and accompanying actuating lever 10, and a jaw assembly 11. The jaw assembly 11 includes first and second punch supports 12, 16. Punches 14 having punching heads 24, 26, 28 (FIGS. 2–3) are carried by and mounted to the supports 12, 16. Those skilled in the art will recognize and appreciate the various strapping machines that may include different embodiments of grippers, feed wheels and/or accompanying levers and cutters, or other structures used to grip a strap, tension a strap around a load and cut the strap.

Figure 4:
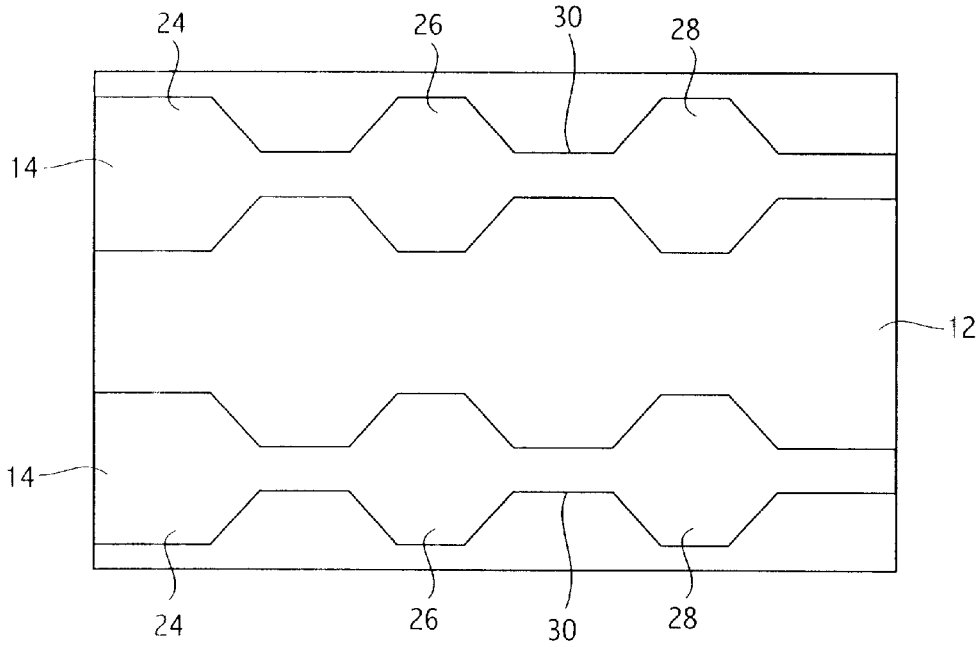
FIG. 4 is a top view of the moveable punch support of the strapping machine shown in FIG. 1 having two progressive punches mounted thereto.
Figure 5:
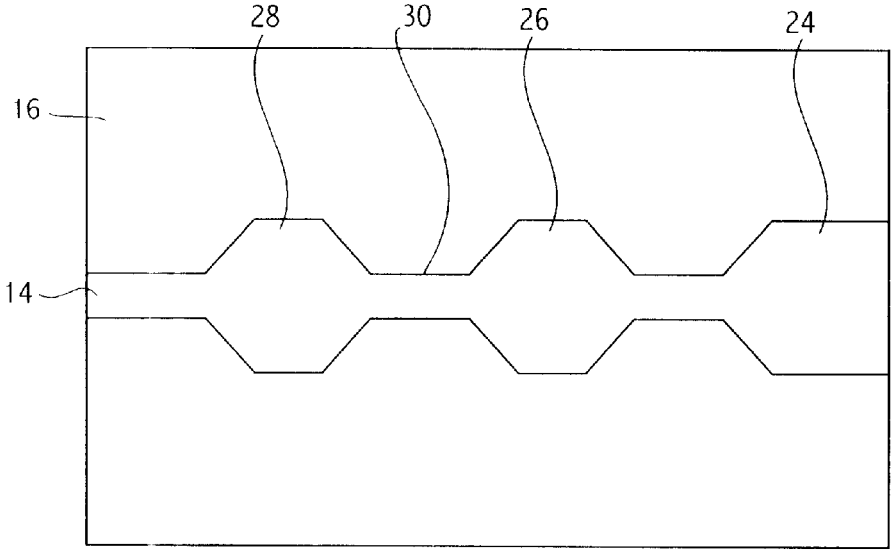
FIG. 5 is a top view of the fixed support of the strapping machine shown in FIG. 1 and the progressive punch mounted thereto.
Figure 6:
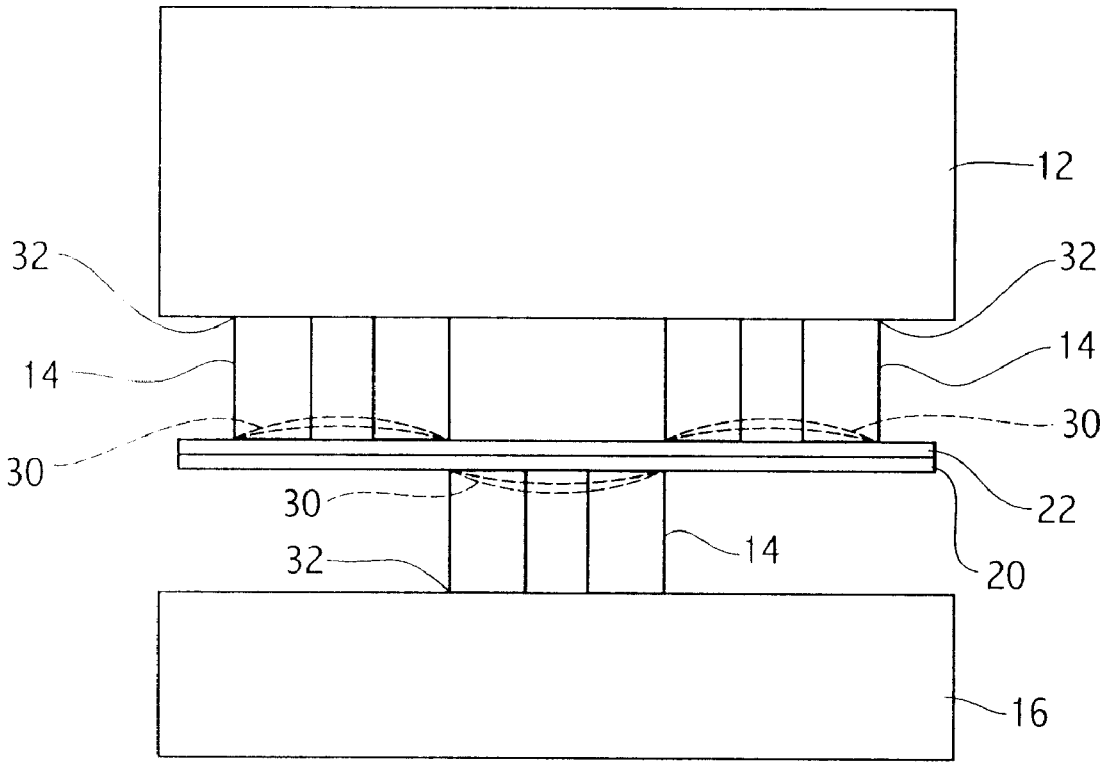
FIG. 6 illustrates movable and fixed punch supports and their respective punches acting in conjunction with one another with a portion of strap material.

Referring now to FIGS. 4–6, the second support 16 is fixed and includes one punch 14. The first punch support 12 is moveable toward and away from the fixed support 16 and includes two punches 14.

Typically, manual strapping machines are used to strap several groups of articles (e.g., a load) together. In that many of these machines or tools are portable, they are known to be used at, for example, a logging site or warehouse facility. Operators must repeatedly apply a force to the actuation lever to effect a seal each time articles are strapped together. This inevitably results in operator fatigue. It is desirable, therefore, to provide a sealing element or punch that allows a seal of sufficient strength to be formed while reducing the amount or magnitude of force required. This can be accomplished by minimizing sealing head surface area that initially engages the strap, thus concentrating the force and increasing the magnitude of pressure applied to the strap.

Figure 2:
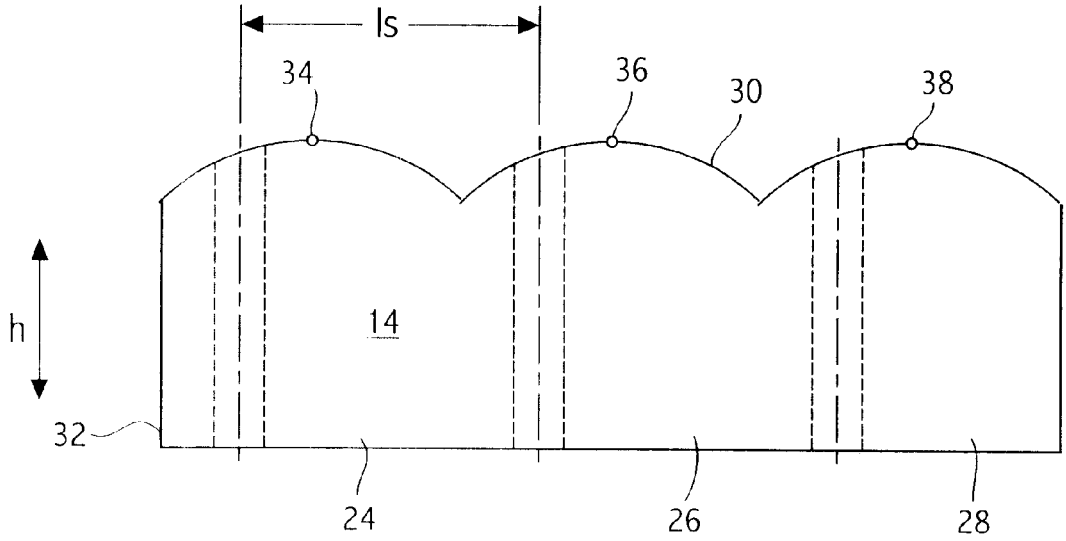
FIG. 2 is a front view of an embodiment of the progressive punch in accordance with the principles of the present invention.
Figure 3:
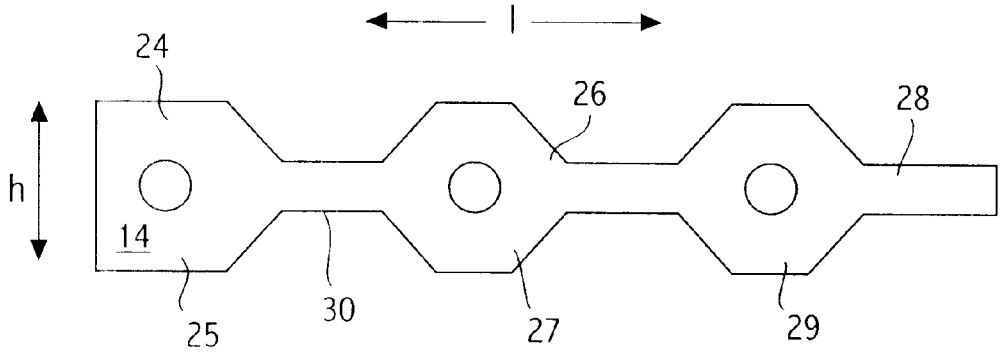
FIG. 3 is a top view of the progressive punch shown in FIG. 2.

The present progressive punch 14 is used in a strapper and is configured to effect minimum punch surface area engagement with the strap at engagement. Referring now to FIG. 2, there is shown one embodiment of a progressive punch 14 embodying the principles of the present invention. The punch 14 includes first, second and third punching heads 24, 26 and 28, respectively. As seen in FIG. 3, the punch 14 defines a height axis (h), a length axis (l) and a width axis (w). Each punching head 24, 26, 28 has a cutting edge 30 and a base 32 portion. In the illustrated embodiment, the punching heads 24, 26, 28 are integral (e.g., formed as part of and machined together) with one another, such that their respective bases 32 are a unitary element and their cutting edges 30 are contiguous with one another.

Referring again to FIG. 2, each punching head 24, 26, 28 has an outermost peripheral point 34, 36, 38, respectively, at its cutting edge 30. The outermost peripheral point of each punching head is linearly spaced with respect to corresponding outermost peripheral points of the other punching heads. That is, the height of each punching head $h_{24}$, $h_{26}$, $h_{28}$ relative to a plane $P_m$ perpendicular to the direction of movement, as indicated at M, of the punch 14 is different from the height $h_{24}$, $h_{26}$, $h_{28}$ of each other head. In this manner, as will be described herein, the punching heads 24, 26, 28 contact the strap 20, 22 sequentially or progressively (i.e., at different times) when the strapper 2 is actuated to form the strap seal.

The direction of linear spacing between the head heights $h_{24}$, $h_{26}$, $h_{28}$ is substantially along the height axis h of the punch 14. For example, when the illustrated strapper 2 is horizontally oriented, as shown in FIG. 1, the linear spacing between head heights $h_{24}$, $h_{26}$, $h_{28}$ would be vertical.

The linear spacing allows less than all of the punching heads 24, 26, 28 to engage the strap at one time, thus reducing the punch surface area that engages the strap at initial engagement. As a result, the force is concentrated at that portion of the strap at which the first (e.g., highest) head first contacts the strap. Thus, the same applied force results in greater applied pressure to the strap at that first contact location. In other words, the peak resultant force required for known punches will be about three times the peak applied force for one punching head. This is because all three punching heads engage the strap at the same time. As described above, in punches of the present invention, the punching heads engage the strap at different times. Thus, the required peak resultant force is less than three times the peak applied force of one punching head.

It is to be understood that although the embodiment illustrated in FIG. 2 shows three punching heads 24, 26, 28, each being linearly spaced with respect to the other, those skilled in the art will recognize that other punch configurations that fall within the scope and spirit of the present invention. For example, incorporating two or more punching heads onto a punch are within the scope and spirit of the present invention, as are incorporating three punching heads in which only two of the punching heads are linearly spaced from one another are within the scope and spirit of the present invention. It is to be further understood that although the illustrated punch 14 is shown having the punch head heights $h_{24}$, $h_{26}$, $h_{28}$ being serially stepped (that is, $h_{24}$ being greater than $h_{26}$ which is greater than $h_{28}$), the order of these heights can be varied and arranged in any manner, again, within the scope and spirit of the present invention.

As seen in FIG. 2, the punching heads 24, 26, 28 have an arcuate cutting edge profile. The punching heads 24, 26, 28 are substantially defined by linearly arranged, octagons 25, 27, 29, adjacent and connected to one another. In a present embodiment, the octagonal bodies 25, 27, 29 are linearly spaced (Is) from each other along the length axis by about 12.5 mm.

Referring to FIGS. 4–6, two punches 14 are mounted to the moveable punch support 12 at their respective bases 32, and one punch 14 is mounted to the fixed support 16 at its respective base 32. FIG. 6 illustrates the arrangement and cooperation of the two punches 14 of the movable support 12 with the punch 14 of the fixed support 16, as when an operator applies a force to the actuating lever 10, causing the movable support 12 (and its punches 14) to move into engagement with the fixed support 16 (and its punch 14) to engage the strap. As can be seen from FIG. 6, as the movable support 12 moves into contact with the fixed support 16 (with the strap therebetween), the respective punches 14 of the movable support 16 and the fixed support 12 overlap one another. In this manner, the punch 14 of the fixed support 12 engages the strap in between the punches of the movable support 16.

In use, a first end 18 of strapping material (S), which can be stored on a roll, is passed around the load L and is fed into the jaws 11, between the first punch support 12 and second punch support 16 and is held between the feed wheel 6 and the gripper (not shown). This results in an overlap of strapping material (S) so the first end 18, which is held by the gripper, forms a lower layer 20 of strapping material. An upper layer 22 of strapping material, which may still be connected to the roll, overlaps the lower layer 20. The feed lever (not shown) is actuated which in turn rotates the feed wheel 6, to tighten the strap around the load L. The strap is then sealed to itself and is cut at the upper layer 22 from the roll by the cutter.

When the operator applies force via the lever 10, the cutting edge 30 of the punch 14 of the fixed support 16 engage upwardly on a lower portion of the lower strap 20 and the cutting edges 30 of the punches 14 of the movable support 12 engage downwardly on an upper portion of the upper strap 22. As shown in FIG. 6, this causes the punches 14, which are attached to the supports 12, 16, to punch the upper layer 22 of strap material onto the lower layer 20 of the strap material and effect a seal.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A punch formed as a unitary element for use with an associated strapping tool for forming a seal between two portions of strapping material, the strapping tool including a jaw having a fixed support and a movable support movable toward and away from the fixed support in a direction of movement to engage the two portion of strapping material therebetween, the punch comprising:

at least two punching heads including cutting edges with arcuate profiles integrally and fixedly attached to one another, a first punching head having a height defined by a distance between an outermost peripheral point of the first punching head and a plane perpendicular to the direction of movement, and a second punching head having a height defined by a distance between an outermost peripheral point of the second punching head and the plane perpendicular to the direction of movement, wherein the height of the first punching head is different from the height of the second punching head.

2. The punch in accordance with claim 1 further indicating a third punching head possessing a cutting edge with an arcuate profile, wherein the third punching head is integrally and fixedly attached to at least one of the first and second punching heads and wherein the third punching head has a height defined by a distance between an outermost peripheral point of the third punching head and the plane perpendicular to the direction of movement, the height of the third punching head being different from at least one of the first and second punching head heights.

3. The punch in accordance with claim 2 wherein the third punching head height is different from both of the first and second punching head heights.

4. The punch in accordance with claim 2 wherein at least one of the first, second, and third punching heads is substantially octagonal in shape.

5. The punch in accordance with claim 1 wherein at least one of the first and second punching heads is substantially octagonal in shape.

6. A strapping tool for forming a seal between two portions of strapping material, comprising:

a jaw assembly;

a fixed support carried by the jaw assembly;

a movable support carried by the jaw assembly;

an actuating lever operably connected to the movable support for moving the movable support toward and away from the fixed support in a direction of movement for engaging the strapping material;

a fixed punch formed as a unitary element carried by the fixed support;

a movable punch formed as a unitary element carried by the movable support for movement toward and away from the fixed punch, both the fixed punch and the movable punch including first and second punching heads including cutting edges with arcuate profiles integrally and fixedly attached to one another, each of the first punching heads having a height defined by a distance between a respective outermost peripheral point of the first punching head and a plane perpendicular to the direction of movement, and each of the second punching heads having a height defined by a distance between a respective outermost peripheral point of the second punching heads and a plane perpendicular to the direction of movement, wherein the heights of the first punching heads are different from the heights of the second punching heads, and wherein the punching heads progressively engage the strap material with the first punching heads initially engaging the strapping material at a different time than the second punching heads initially engage the strapping material.

7. The strapping tool in accordance with claim 6 wherein both the fixed punch and the movable punch include a third punching head possessing a cutting edge with an arcuate profile, wherein each respective third punching head is integrally and fixedly attached to at least one of its first and second punching heads and wherein each third punching head has a height defined by a distance between an outermost peripheral point of the third punching head and the plane perpendicular to the direction of movement, the respective heights of the third punching heads being different from at least one of the respective first and second punching head heights.

8. The strapping tool in accordance with claim 7 wherein the respective third punching head heights are different from both of the respective first and second punching head heights.

9. The strapping tool in accordance with claim 7 wherein an outermost peripheral point of each first punching head is linearly spaced with respect to a corresponding outermost peripheral point of each respective second punching head and wherein an outermost peripheral point of each third punching head is linearly spaced with respect to outermost peripheral points of respective first and second punching heads, the directions of linear spacing being substantially defined by height axes of the respective punches.

10. The strapping tool in accordance with claim 6 wherein at least one of the first, second, and third punching heads is substantially octagonal in shape.

11. The strapping tool in accordance with claim 6 wherein the movable support includes a pair of movable punches integrally and fixedly mounted to the support relative to one another.

12. The strapping tool in accordance with claim 6 wherein at least one of the first and second punching heads is substantially octagonal in shape.

13. A jaw assembly for use in a strapping tool for forming a seal between two portions of strapping material, the jaw assembly comprising:

a fixed support;

a movable support;

an actuating lever operably connected to the movable support for moving the movable support toward and away from the fixed support in a direction of movement for engaging the strapping material;

a fixed punch formed as a unitary element carried by the fixed support;

a movable punch formed as a unitary element carried by the movable support for movement toward and away from the fixed punch, both the fixed punch and the movable punch including first and second punching heads including cutting edges with arcuate profiles integrally and fixedly attached to one another, each of the first punching heads having a height defined by a distance between a respective outermost peripheral point of the first punching head and a plane perpendicular to the direction of movement, and each of the second punching heads having a height defined by a distance between a respective outermost peripheral point of the second punching heads and the plane perpendicular to the direction of movement, wherein the heights of the first punching heads are different from the heights of the second punching heads, and wherein the punching heads progressively engage the strap material, with the first punching heads initially engaging the strapping material at a different time than the second punching heads initially engage the strapping material.

14. The jaw assembly in accordance with claim 13 wherein both the fixed punch and the movable punch include a third punching head possessing a cutting edge with an arcuate profile, wherein each respective third punching head is integrally and fixedly attached to at least one of its first and second punching heads and wherein each third punching head has a height defined by a distance between an outermost peripheral point of the third punching head and the plane perpendicular to the direction of movement, the respective heights of the third punching heads being different from at least one of the respective first and second punching head heights.

15. The jaw assembly in accordance with claim 14 wherein the respective third punching head heights are different from both of the respective first and second punching head heights.

16. The jaw assembly in accordance with claim 14 wherein an outermost peripheral point of each first punching head is linearly spaced with respect to a corresponding outermost peripheral point of each respective second punching head and wherein an outermost peripheral point of each third punching head is linearly spaced with respect to outermost peripheral points of respective first and second punching heads, the directions of linear spacing being substantially defined by height axes of the respective punches.

17. The jaw assembly in accordance with claim 13 wherein the movable support includes a pair of movable punches integrally and fixedly mounted to the support relative to one another.

18. The jaw assembly in accordance with claim 17 wherein each of the movable punches and the fixed punches includes a cutting edge at the outermost edges thereof.

19. The jaw assembly in accordance with claim 18, wherein the fixed punch is disposed on the fixed support such that when the fixed and movable punches engage the strap portions therebetween, the cutting edges of the fixed punch overlie the cutting edges of the movable punches.

20. The jaw assembly in accordance with claim 13 wherein at least one of the first and second punching heads is substantially octagonal in shape.

* * * * *